US011664571B2

(12) United States Patent
Tokuda et al.

(10) Patent No.: US 11,664,571 B2
(45) Date of Patent: May 30, 2023

(54) COUPLER MODULE

(71) Applicant: Murata Manufacturing Co., Ltd., Kyoto (JP)

(72) Inventors: Daisuke Tokuda, Kyoto (JP); Hisanori Murase, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/236,271

(22) Filed: Apr. 21, 2021

(65) Prior Publication Data

US 2021/0242561 A1 Aug. 5, 2021

Related U.S. Application Data

(63) Continuation of application No. PCT/JP2019/049156, filed on Dec. 16, 2019.

(30) Foreign Application Priority Data

Dec. 17, 2018 (JP) ..... JP2018-235771

(51) Int. Cl.
*H01P 5/18* (2006.01)

(52) U.S. Cl.
CPC ..... *H01P 5/187* (2013.01); *H01P 5/182* (2013.01); *H01P 5/184* (2013.01); *H01P 5/185* (2013.01)

(58) Field of Classification Search
CPC ..... H01P 5/18; H01P 5/182; H01P 5/184–186
USPC ..... 333/109–111
See application file for complete search history.

(56) References Cited

U.S. PATENT DOCUMENTS 4,644,260 A 2/1987 Warder
6,972,640 B2 * 12/2005 Nagamori ..... H01P 5/187 333/116
7,042,309 B2 * 5/2006 Podell ..... H01P 5/187 333/156
7,187,910 B2 * 3/2007 Kim ..... H01P 5/185 455/553.1
8,358,179 B2 * 1/2013 Frye ..... H05K 1/0233 333/4

(Continued)

FOREIGN PATENT DOCUMENTS

CN 111902999 A 11/2020
JP H08-307115 A 11/1996

(Continued)

OTHER PUBLICATIONS

International Search Report issued in Application No. PCT/JP2019/049156, dated Jan. 28, 2020.

(Continued)

*Primary Examiner* — Rakesh B Patel
(74) *Attorney, Agent, or Firm* — Pearne & Gordon LLP

(57) ABSTRACT

A coupler module includes a coupler component formed with a main line and a sub-line that configure a directional coupler, and a module substrate on which the coupler component is mounted and on which a wiring conductor coupled in series with the main line is formed. At least a part of the wiring conductor is along the main line in plan view of the module substrate, and a direction of a main signal flowing through the main line and a direction of the main signal flowing through the part of the wiring conductor are opposite to each other.

19 Claims, 6 Drawing Sheets

(56) References Cited

U.S. PATENT DOCUMENTS

| | | | | |
|---|---|---|---|---|
| 8,390,391 | B2 * | 3/2013 | Frye | H01L 23/64 333/25 |
| 2013/0141184 | A1 | 6/2013 | Tamaru et al. | |
| 2021/0013579 | A1 | 1/2021 | Tokuda | |

FOREIGN PATENT DOCUMENTS

| | | | |
|---|---|---|---|
| WO | 2012017713 | A1 | 2/2012 |
| WO | 2019189228 | A1 | 10/2019 |

OTHER PUBLICATIONS

Written Opinion issued in Application No. PCT/JP2019/049156, dated Jan. 28, 2020.

* cited by examiner

COUPLER MODULE

CROSS REFERENCE TO RELATED APPLICATION

This is a continuation of International Application No. PCT/JP2019/049156 filed on Dec. 16, 2019 which claims priority from Japanese Patent Application No. 2018-235771 filed on Dec. 17, 2018. The contents of these applications are incorporated herein by reference in their entireties.

BACKGROUND OF THE DISCLOSURE

Field of the Disclosure

The present disclosure relates to a coupler module in which a directional coupler is mounted on a substrate.

Description of the Related Art

A directional coupler configured of a main line and a sub-line that are formed in a multilayer body has been known (for example, Patent Document 1). The directional coupler of Patent Document 1 is used while being mounted on a substrate.

Patent Document 1: International Publication No. 2012/017713

BRIEF SUMMARY OF THE DISCLOSURE

When a directional coupler is mounted on a substrate alone or with other elements to form a coupler module, an effective coupling degree of the directional coupler may vary due to the influence of a parasitic component of the substrate or the influence of the other elements. The variation in coupling degree may be a factor that impairs the accuracy of a detection signal outputted from the directional coupler.

Therefore, an object of the present disclosure is to provide a coupler module in which a directional coupler is mounted on a substrate and an effective coupling degree of the directional coupler can be easily adjusted.

In order to achieve the above object, a coupler module according to an aspect of the present disclosure includes a component formed with a main line and a sub-line that configure a directional coupler, and a substrate on which the component is mounted and on which a wiring coupled in series with the main line is formed, and at least a part of the wiring is along the main line in plan view of the substrate.

In addition, a coupler module according to an aspect of the present disclosure includes a component formed with a main line and a sub-line that configure a directional coupler, and a substrate on which the component is mounted and a wiring coupled in series with the main line is formed, and at least a part of the wiring overlaps with the sub-line in plan view of the substrate.

With this, a magnetic field obtained by synthesizing the magnetic fields generated by a main signal in or around a part of the wiring with the magnetic fields generated in or around the main line is caused to act on the sub-line, capacitive coupling is formed between the part of the wiring line and the sub-line, and thus, an effective coupling degree of the directional coupler can be adjusted. For example, in a case where the coupling degree is deviated when the directional coupler is mounted on the substrate, the coupling degree can be corrected by changing a wiring pattern of the substrate. Since the wiring pattern of the substrate can be changed in a region overlapping with the directional coupler in plan view of the substrate, the coupling degree can be adjusted without an increase in size of the coupler module. Further, since the substrate is modified, it is possible to adjust the coupling degree in a short period of time and at a low cost, compared to a case where the directional coupler itself is modified. As a result, the coupler module that facilitates the adjustment of the effective coupling degree of the directional coupler can be obtained.

Figure 2A:
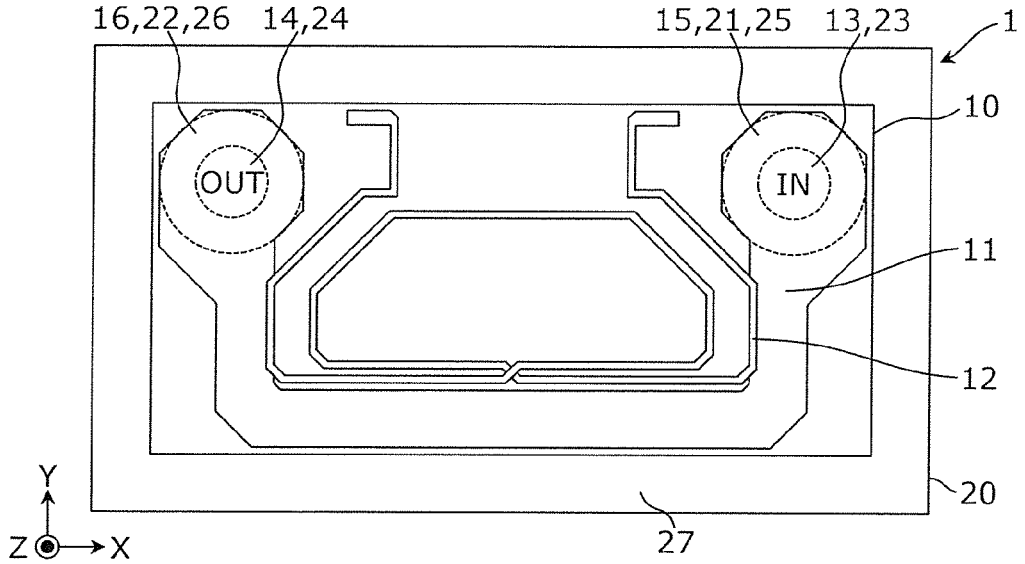
Figure 2B:
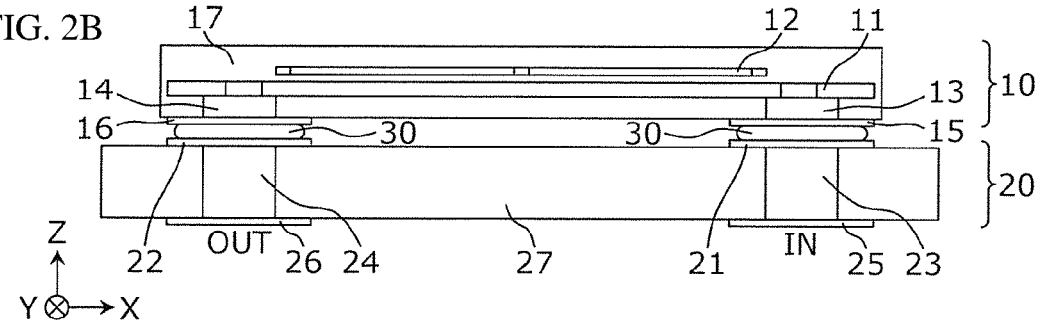

Each of FIGS. 2A and 2B is a diagram illustrating an example of a basic structure of a coupler module.

Figure 3A:
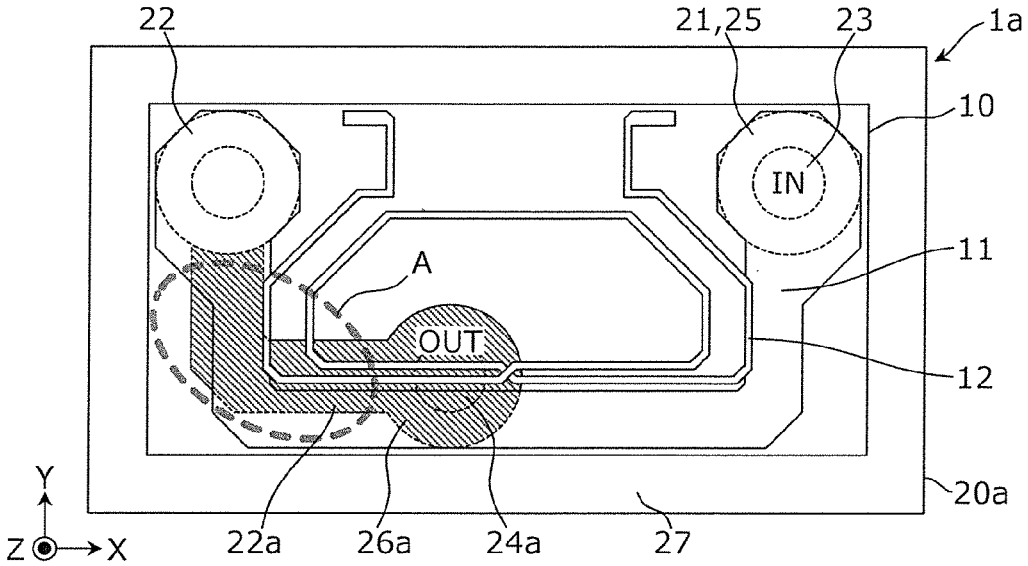
Figure 3B:
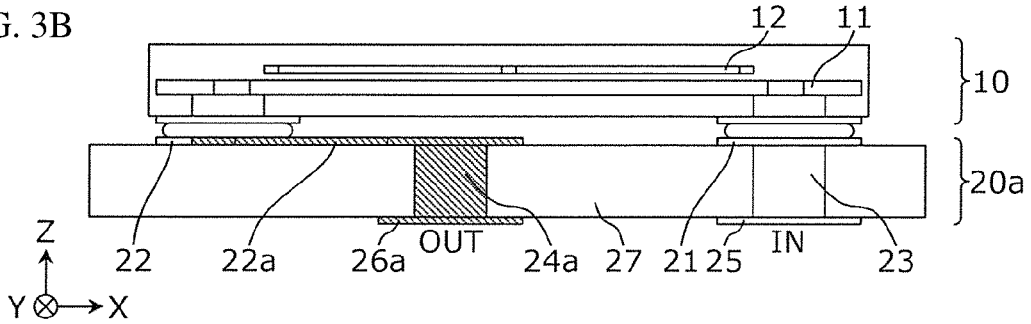

Each of FIGS. 3A and 3B is a diagram illustrating an example of a structure of a coupler module according to Embodiment 1.

Figure 4:
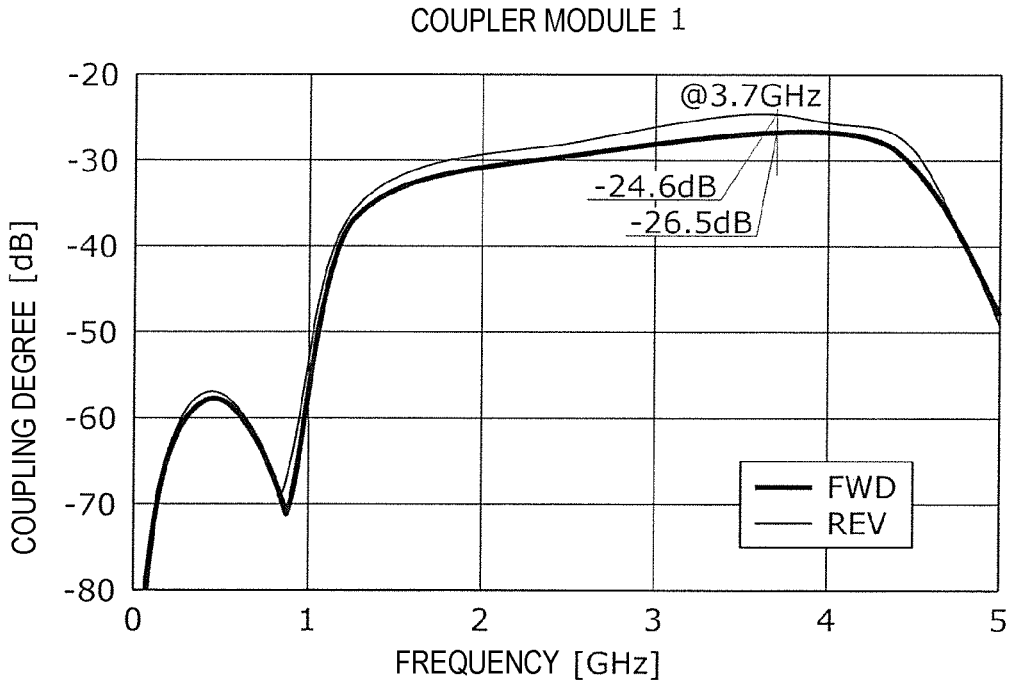

FIG. 4 is a graph showing an example of a coupling degree of a coupler module having a basic structure.

Figure 5:
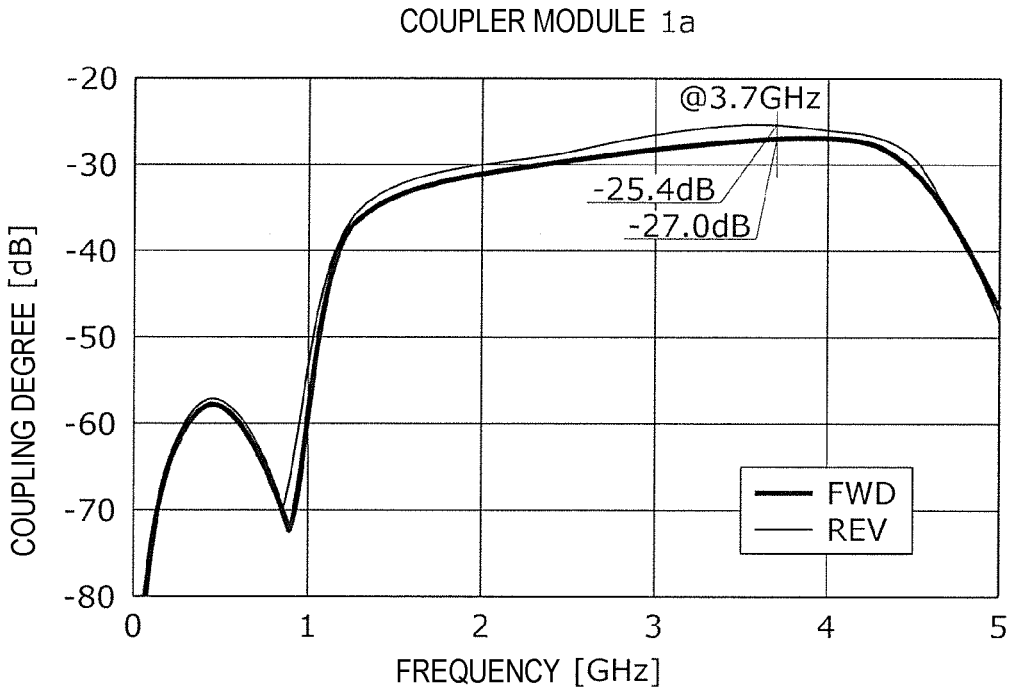

FIG. 5 is a graph showing an example of a coupling degree of the coupler module according to Embodiment 1.

Figure 6A:
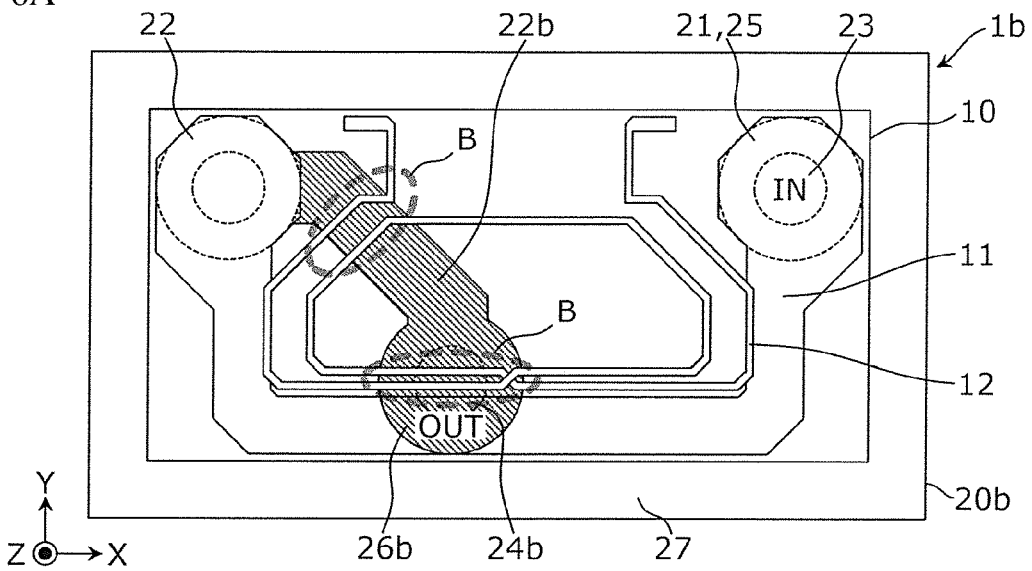
Figure 6B:
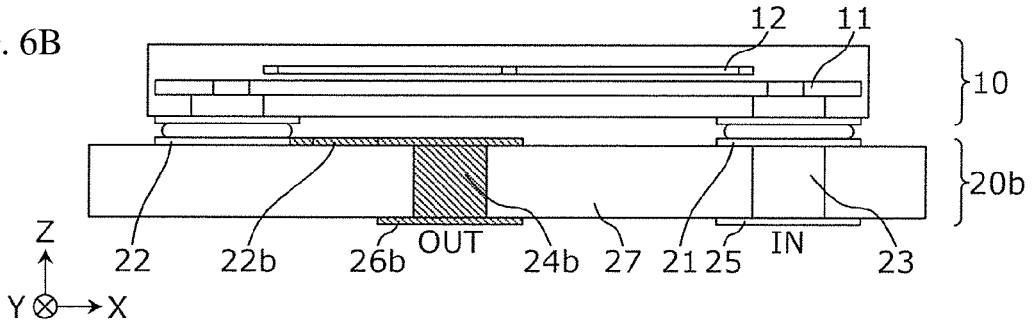

Each of FIGS. 6A and 6B is a diagram illustrating an example of a structure of a coupler module according to Embodiment 2.

Figure 7:
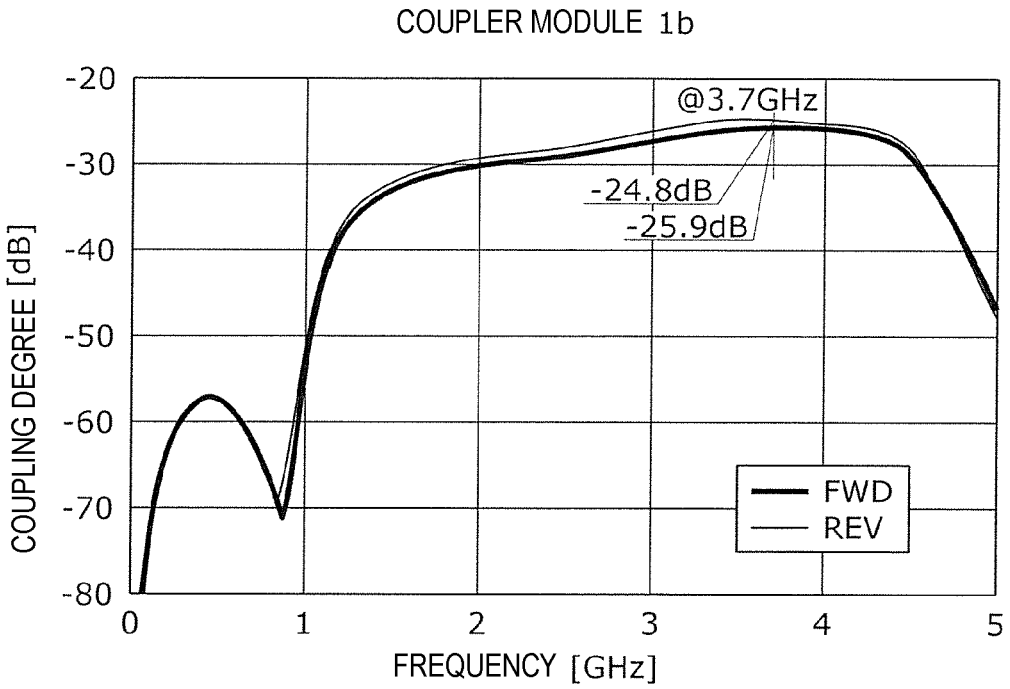

FIG. 7 is a graph showing an example of a coupling degree of the coupler module according to Embodiment 2.

Figure 8A:
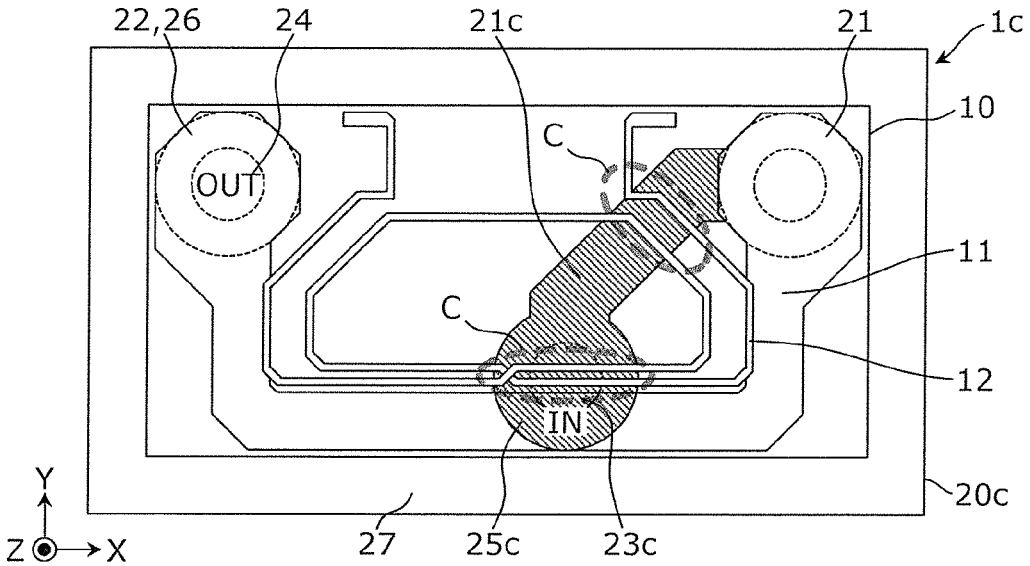
Figure 8B:
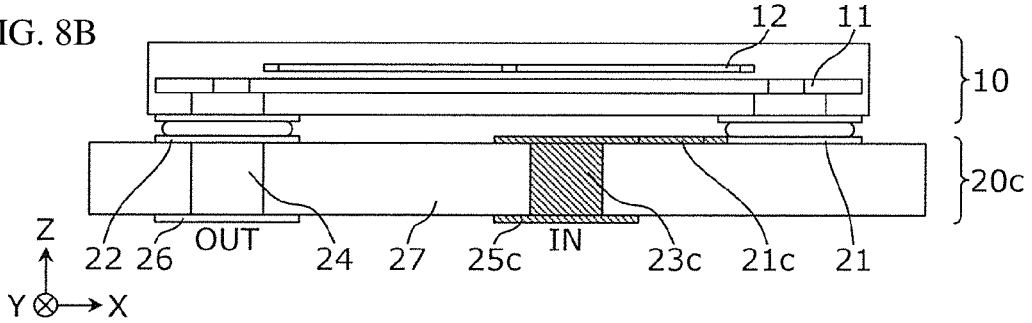

Each of FIGS. 8A and 8B is a diagram illustrating an example of a structure of a coupler module according to Embodiment 3.

Figure 9A:
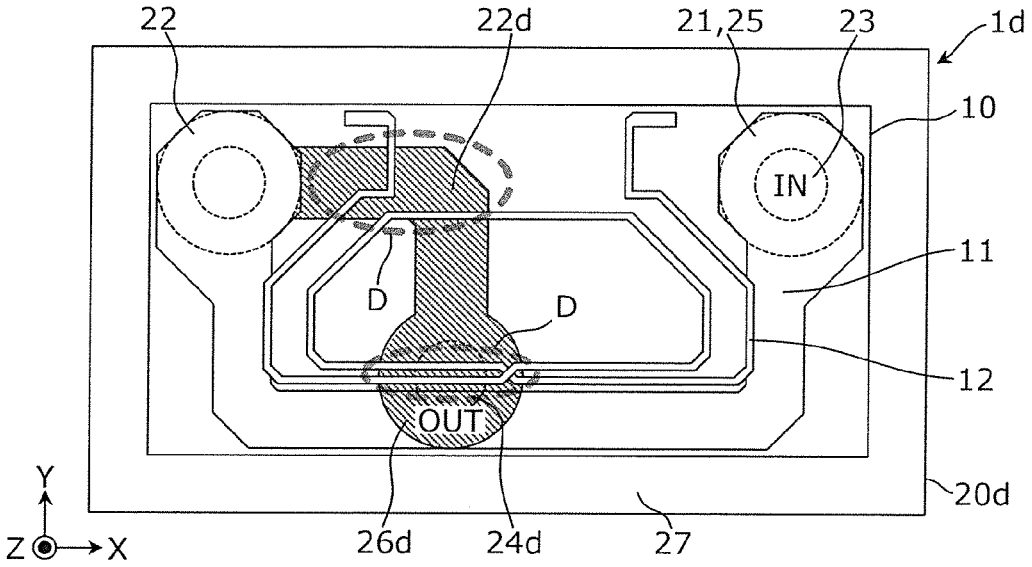
Figure 9B:
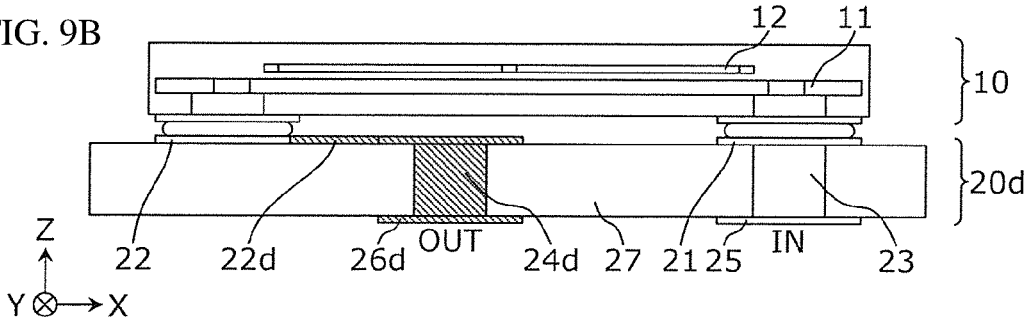

Each of FIGS. 9A and 9B is a diagram illustrating an example of a structure of a coupler module according to Embodiment 4.

Figure 10:
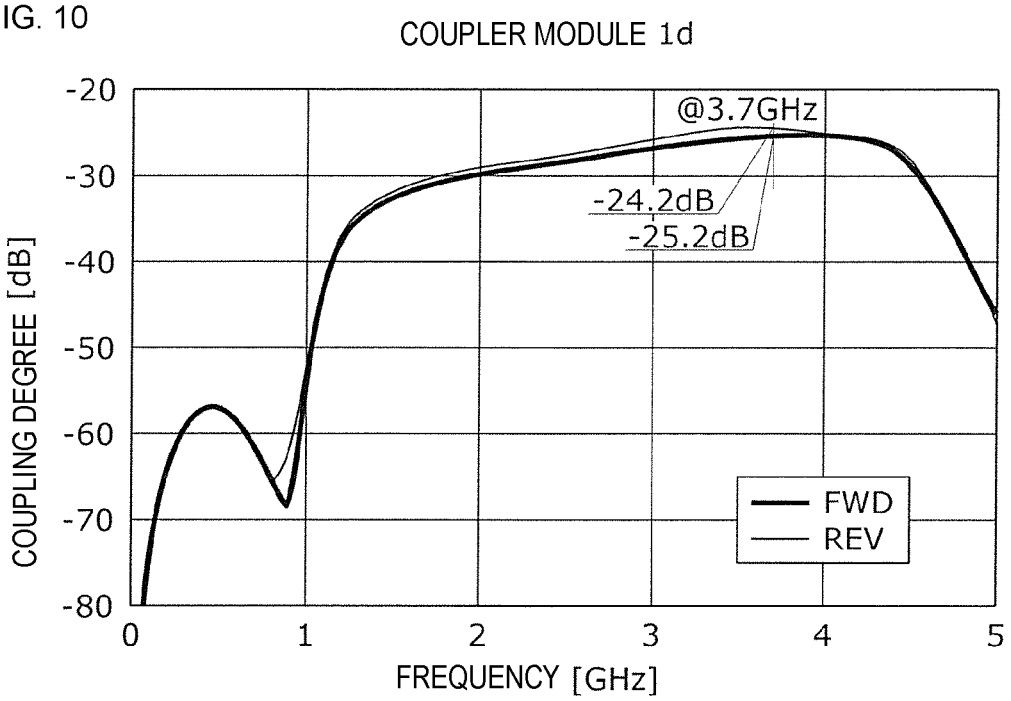

FIG. 10 is a graph showing an example of a coupling degree of the coupler module according to Embodiment 4.

Figure 11A:
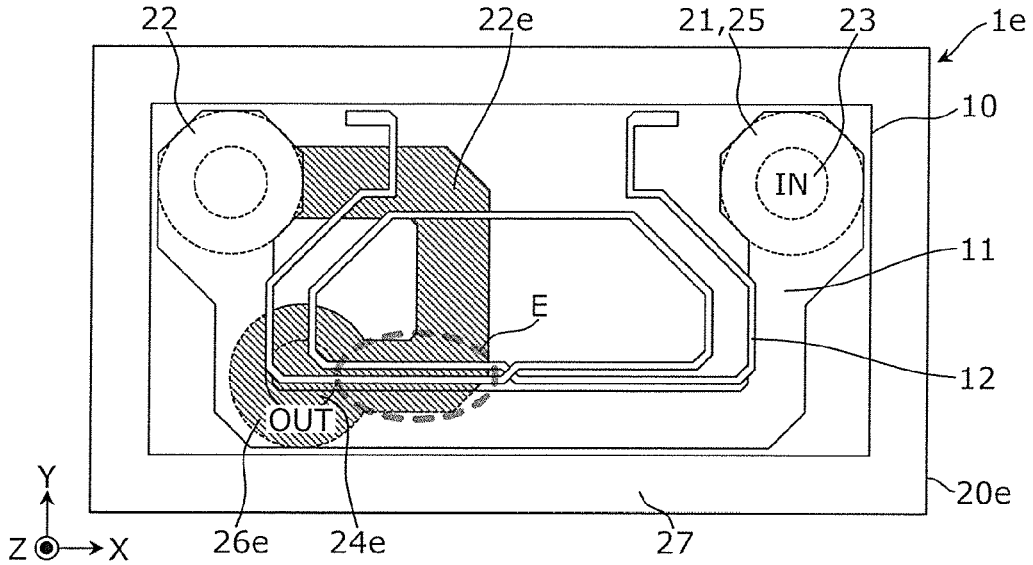
Figure 11B:
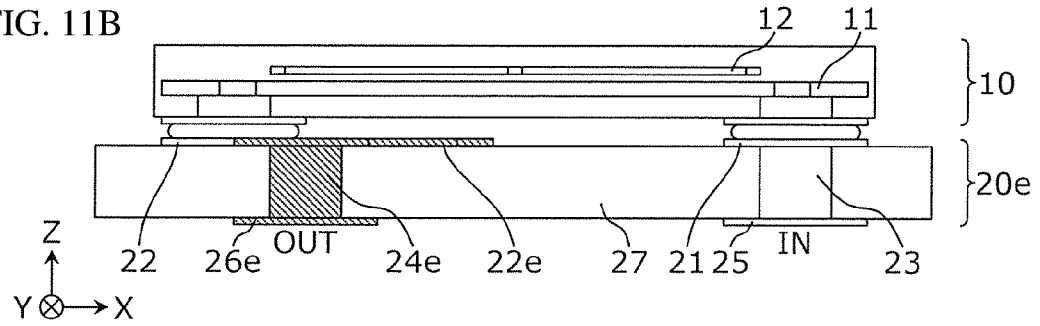

Each of FIGS. 11A and 11B is a diagram illustrating an example of a structure of a coupler module according to Embodiment 5.

DETAILED DESCRIPTION OF THE DISCLOSURE

A plurality of embodiments of the present disclosure will be described in detail with reference to the accompanying drawings. It should be noted that the embodiments to be described below all represent general or specific examples. The numerical values, shapes, materials, constituent elements, arrangement and coupling forms of the constituent elements, and the like, which will be described in the following embodiments, are mere examples and are not intended to limit the present disclosure.

Embodiment 1

A coupler module according to Embodiment 1 will be described.

Figure 1:
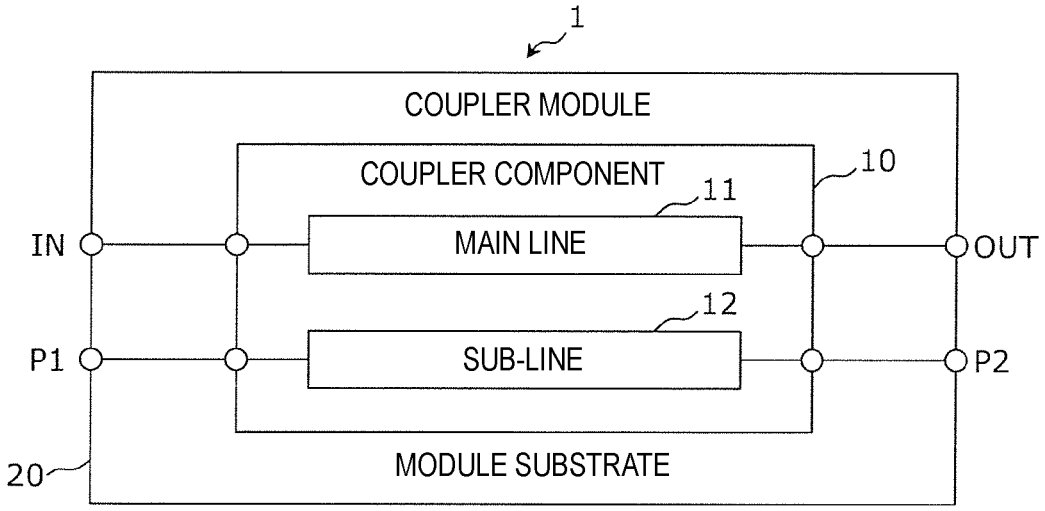
FIG. 1 is a functional block diagram illustrating an example of a configuration of a general coupler module.

FIG. 1 is a functional block diagram illustrating an example of a general configuration of a coupler module. As illustrated in FIG. 1, the coupler module 1 includes a coupler component 10 and a module substrate 20.

The coupler component 10 includes a directional coupler configured of a main line 11 and a sub-line 12.

The module substrate 20 has an input port IN, an output port OUT, a first port P1, and a second port P2.

One end and the other end of the main line 11 are coupled to the input port IN and the output port OUT, respectively. One end and the other end of the sub-line 12 are coupled to the first port P1 and the second port P2, respectively.

The main line 11 and the sub-line 12 are electromagnetically coupled to each other. Due to the electromagnetic coupling between the main line 11 and the sub-line 12, a part of a power of a main signal flowing through the main line 11 in a direction from the input port IN toward the output port OUT (hereinafter referred to as a forward direction) is outputted from the first port P1. Further, a part of a power of a main signal flowing through the main line 11 in a direction from the output port OUT toward the input port IN (hereinafter referred to as a reverse direction) is outputted from the second port P2. The signals outputted from the first port P1 and the second port P2 are used as detection signals indicating the magnitudes of a main signal in the forward direction and a main signal in the reverse direction, respectively.

Note that a port, of the first port P1 and the second port P2, that does not output a signal is terminated by using a termination circuit (not illustrated). Specifically, when the signal in the forward direction is outputted from the first port P1, the second port P2 is terminated, and when the signal in the reverse direction is outputted from the second port P2, the first port P1 is terminated.

In this specification, a power ratio of the detection signal to the main signal is referred to as coupling degree, and the coupling degree is quantitatively expressed as a negative decibel value. The coupling degree is individually defined for each of the main signal in the forward direction and the main signal in the reverse direction. Further, an end portion coupled to the input port IN of the main line 11 is referred to as an input end, and an end portion coupled to the output port OUT of the main line 11 is referred to as an output end.

Each of FIGS. 2A and 2B is a diagram illustrating an example of a basic structure of the coupler module 1, and FIG. 2A is a plan view and FIG. 2B is a side view. As illustrated in FIGS. 2A and 2B, the coupler module 1 is configured by mounting the coupler component 10 on the module substrate 20 as a basic structure.

The coupler component 10 includes the main line 11, the sub-line 12, via conductors 13 and 14, and coupling electrodes 15 and 16 all of which are formed in or on a substrate 17. One end and the other end of the main line 11 are coupled to the coupling electrodes 15 and 16 with the via conductors 13 and 14 interposed therebetween, respectively. One end and the other end of the sub-line 12 are also coupled to the coupling electrodes with the via conductors interposed therebetween (not illustrated).

The coupler component 10 may be, for example, an integrated circuit chip in which each portion is formed on the substrate 17 in a semiconductor process by using a silicon substrate as the substrate 17.

The module substrate 20 includes upper coupling electrodes 21 and 22, via conductors 23 and 24, and lower coupling electrodes 25 and 26 all of which are formed in or on the substrate 27. The lower coupling electrodes 25 and 26 are coupled to the upper coupling electrodes 21 and 22 with the via conductors 23 and 24 interposed therebetween, respectively.

The module substrate 20 may be, for example, a multilayer wiring substrate in which a plurality of base material layers made of a resin material or a ceramic material are laminated.

The coupler component 10 is mounted on the module substrate 20 by bonding the coupling electrodes 15 and 16 of the coupler component 10 and the upper coupling electrodes 21 and 22 of the module substrate 20 with a conductive bonding material 30 such as solder. Accordingly, the lower coupling electrodes 25 and 26 are respectively connected to one end and the other end of the main line 11, and function as the input port IN and the output port OUT.

The module substrate 20 is provided with lower coupling electrodes that are coupled to one end and the other end of the sub-line 12 in a similar manner and that function as the first port P1 and the second port P2 (not illustrated).

The coupler module 1 is coupled to an external device that utilizes the coupler module 1 through the lower coupling electrodes of the module substrate 20 including the lower coupling electrodes 25 and 26.

The coupler component 10 is mounted alone on the module substrate 20 or is mounted together with other components on the module substrate 20. As described above, when the coupler component 10 is mounted on the module substrate 20, an effective coupling degree of the directional coupler in the coupler component 10 may vary due to the influence of a parasitic component of the module substrate 20 and the influence of the other components mounted together with the coupler component 10 on the module substrate 20. The variation in coupling degree may be a factor that impairs the accuracy of a detection signal outputted from the directional coupler.

Although the coupling degree of the directional coupler can be corrected by modifying the coupler component 10, when the coupler component 10 is configured of an integrated circuit chip, it takes a great deal of time and cost to modify the coupler component 10.

Thus, the inventors have conducted intensive studies on a coupler module capable of adjusting a coupling degree in a shorter period of time and at a lower cost, and as a result, the inventors have conceived of a coupler module having the following structure.

Each of FIGS. 3A and 3B is a diagram illustrating an example of a structure of a coupler module according to Embodiment 1, and FIG. 3A is a plan view and FIG. 3B is a side view. As illustrated in FIGS. 3A and 3B, in a coupler module 1*a*, a wiring conductor 22*a* is added to a module substrate 20*a*, and the arrangement of a via conductor 24*a* and a lower coupling electrode 26*a* is changed as compared with the coupler module 1 in FIGS. 2A and 2B. The coupler component 10 is not changed.

In FIGS. 3A and 3B, constituent elements that are added to or changed from the coupler module 1 among the constituent elements of the module substrate 20*a* are highlighted by hatching lines, and signs of some constituent elements among the constituent elements of the coupler component 10 are omitted.

As illustrated in FIGS. 3A and 3B, the wiring conductor 22*a* is formed on an upper surface of the module substrate 20*a*, one end thereof is coupled to the upper coupling electrode 22, and the other end thereof is coupled to the lower coupling electrode 26*a* with the via conductor 24*a* interposed therebetween. The wiring conductor 22*a* is an example of a wiring coupled in series with the main line 11.

In plan view, at least a part (for example, a portion A) of the wiring conductor 22*a* is provided along the main line 11. Here, the fact that a part of the wiring conductor 22*a* is along the main line 11 means that the shortest distance (the shortest distance projected onto an XY plane in the example of FIGS. 3A and 3B) in plan view between a part of the wiring conductor 22*a* and the main line is maintained at a substantially constant value including a distance of zero. Note that the case where the shortest distance between the part of the wiring conductor 22*a* and the main line is maintained at the distance of zero indicates a case where the part of the wiring conductor 22*a* overlaps with the main line in plan view.

By arranging the portion A of the wiring conductor 22*a* along the main line 11, an effective coupling degree of a directional coupler can be adjusted by causing a magnetic field obtained by synthesizing a magnetic field generated in the portion A of the wiring conductor 22*a* with a magnetic field generated in the main line 11 by the main signal to act on the sub-line 12.

For example, in the coupler module 1 in FIGS. 2A and 2B, it is assumed that the coupling degree is deviated when the coupler component 10 is mounted on the module substrate 20. In this case, by changing the module substrate 20 to the module substrate 20*a* provided with the wiring conductor 22*a* having the portion A along the main line 11 in plan view as illustrated in FIGS. 3A and 3B, the coupling degree can be corrected.

Since the portion A of the wiring conductor 22*a* can be provided in a region overlapping with the coupler component 10 in plan view, the coupling degree can be adjusted without an increase in size of the coupler module 1*a*. Further, since the module substrate 20*a* is corrected, the coupling degree can be adjusted at a low cost and in a short period of time, as compared with the case where the coupler component 10 itself is corrected.

FIG. 4 is a graph showing an example of the effective coupling degree of the directional coupler in the coupler module 1. In the example of FIG. 4, at a frequency of 3.7 GHz assumed to be utilized, a coupling degree FWD in the forward direction is −26.5 dB, and a coupling degree REV in the reverse direction is −24.6 dB.

FIG. 5 is a graph showing an example of the effective coupling degree of the directional coupler in the coupler module 1*a*. In the example of FIG. 5, at the frequency of 3.7 GHz assumed to be utilized, a coupling degree FWD in the forward direction is −27.0 dB, and a coupling degree REV in the reverse direction is −25.4 dB.

From FIG. 5 and FIG. 4, in the coupler module 1*a*, the coupling degree in the forward direction is 0.5 dB smaller than that in the coupler module 1, and the coupling degree in the reverse direction is 0.8 dB smaller than that in the coupler module 1.

In the coupler module 1*a*, a direction of a main signal flowing through the main line 11 and a direction of the main signal flowing through the portion A of the wiring conductor 22*a* are opposite to each other. Therefore, it is considered that the effective coupling degree of the directional coupler decreases due to the fact that the magnetic field in or around the portion A of the wiring conductor 22*a* and the magnetic field in or around the main line 11 that are in opposite directions to each other are generated by the main signal, and the magnetic field acting on the sub-line is weakened.

As described above, by providing, on the module substrate, a wiring which is coupled in series with the main line, at least a part of which is along the main line, and in which a direction of a main signal flowing through the part is opposite to the direction of the main signal flowing through the main line, it is possible to reduce the effective coupling degree of the directional coupler.

Embodiment 2

A coupler module according to Embodiment 2 will be described.

Each of FIGS. 6A and 6B is a diagram illustrating an example of a structure of a coupler module according to Embodiment 2, and FIG. 6A is a plan view and FIG. 6B is a side view. As illustrated in FIGS. 6A and 6B, in a coupler module 1*b*, a wiring conductor 22*b* is added on a module substrate 20*b*, and the arrangement of a via conductor 24*b* and a lower coupling electrode 26*b* is changed as compared with the coupler module 1 in FIGS. 2A and 2B. The coupler component 10 is not changed.

In FIGS. 6A and 6B, constituent elements that are added to or changed from the coupler module 1 among the constituent elements of the module substrate 20*b* are highlighted by hatching lines, and the signs of some constituent elements among the constituent elements of the coupler component 10 are omitted.

As illustrated in FIGS. 6A and 6B, the wiring conductor 22*b* is formed on an upper surface of the module substrate 20*b*, one end thereof is coupled to the upper coupling electrode 22, and the other end thereof is coupled to the lower coupling electrode 26*b* with the via conductor 24*b* interposed therebetween. The wiring conductor 22*b* is an example of a wiring coupled in series with the main line 11.

At least a part (for example, a portion B) of the wiring conductor 22*b* overlaps with the sub-line 12 in plan view. Since the portion B of the wiring conductor 22*b* is arranged so as to overlap with the sub-line 12, the effective coupling degree of the directional coupler can be increased by forming the capacitive coupling between a part of the wiring and the sub-line.

In addition, in the coupler module 1*b*, a direction of a main signal flowing through the wiring conductor 22*b* is the same as a direction of the main signal flowing through the main line 11. Specifically, for example, in the case where the main signal in the forward direction flows, the main signal flowing through the main line 11 flows in a clockwise direction from the upper coupling electrode 21 side toward the upper coupling electrode 22 side, and the main signal flowing through the wiring conductor 22*b* flows in the clockwise direction from the upper coupling electrode 22 side toward the lower coupling electrode 26*b* side.

In this case, since a direction of a magnetic flux generated by the main signal flowing through the main line 11 and a direction of a magnetic flux generated by the main signal flowing through the wiring conductor 22*b* are in the same direction, an inductance component which the main line 11 has increases. Then, since the main line 11 and the sub-line 12 form stronger magnetic field coupling, it is considered that the effective coupling degree of the directional coupler can also be increased by the magnetic field coupling.

For example, in the coupler module 1 in FIGS. 2A and 2B, it is assumed that the coupling degree is insufficient when the coupler component 10 is mounted on the module substrate 20. In this case, the coupling degree can be compensated by changing the module substrate 20 to the module substrate 20*b* provided with the wiring conductor 22*b* having the portion B overlapping with the sub-line 12 in plan view as illustrated in FIGS. 6A and 6B.

Since the portion B of the wiring conductor 22*b* can be provided in a region overlapping with the coupler component 10 in plan view, the coupling degree can be adjusted without an increase in size of the coupler module 1*b*. Further, since the module substrate 20*b* is corrected, the coupling degree can be adjusted at a low cost and in a short period of time, as compared with the case where the coupler component 10 itself is corrected.

FIG. 7 is a graph showing an example of the effective coupling degree of the directional coupler in the coupler module 1*b*. In the example of FIG. 7, at the frequency of 3.7 GHz assumed to be utilized, a coupling degree FWD in the forward direction is −25.9 dB, and a coupling degree REV in the reverse direction is −24.8 dB.

From FIG. 7 and FIG. 4, in the coupler module 1*b*, the coupling degree in the forward direction is 0.6 dB larger than that in the coupler module 1, and the coupling degree in the reverse direction is 0.2 dB larger than that in the coupler module 1.

In the coupler module 1*b*, the wiring conductor 22*b* is coupled to an output end (an end portion on the output port OUT side) of the main line 11. Thus, it is considered that the coupling degree in the forward direction, of the coupling degree in the forward direction and the coupling degree in the reverse direction, can be selectively increased due to the asymmetry of the circuit.

Further, by selectively increasing the coupling degree in the forward direction, a difference between the coupling degree in the forward direction and the coupling degree in the reverse direction is 1.1 dB in the coupler module 1*b*. As described above, since the difference between the coupling degree in the forward direction and the coupling degree in the reverse direction in the coupler module 1*b* is a smaller value than 1.9 dB which is a difference between the coupling degree in the forward direction and the coupling degree in the reverse direction in the coupler module 1, the directional coupler having better characteristics in which a mismatch between the coupling degree in the forward direction and the coupling degree in the reverse direction is improved can be obtained.

As described above, by providing, on the module substrate, a wiring which is coupled in series with the main line and at least partially overlaps with the sub-line, it is possible to increase the effective coupling degree of the directional coupler. In particular, it is possible to selectively increase the coupling degree in the forward direction by coupling the wiring at least partially overlapping with the sub-line to the output end of the main line. Due to this, the directional coupler having the better characteristics in which the mismatch between the coupling degree in the forward direction and the coupling degree in the reverse direction is improved can be obtained, for example, when the coupling degree in the forward direction is lower than the desired coupling degree.

In FIGS. 6A and 6B, an example has been described in which the wiring conductor 22*b* at least partially overlapping with the sub-line 12 is coupled to the output end of the main line 11, but a similar wiring is not limited to being coupled to the output end of the main line 11, and may be coupled to the input end (an end portion on the input port IN side).

Each of FIGS. 8A and 8B is a diagram illustrating an example of a structure of a coupler module according to a modified example of the second embodiment, and FIG. 8A is a plan view and FIG. 8B is a side view. As illustrated in FIGS. 8A and 8B, in a coupler module 1*c*, a wiring conductor 21*c* is added on the module substrate 20*c*, and the arrangement of a via conductor 23*c* and a lower coupling electrode 25*c* is changed as compared with the coupler module 1 in FIGS. 2A and 2B. The coupler component 10 is not changed. In FIGS. 8A and 8B, constituent elements that are added to or changed from the coupler module 1 among the constituent elements of the module substrate 20*c* are highlighted by hatching lines, and the signs of some constituent elements among the constituent elements of the coupler component 10 are omitted.

As illustrated in FIGS. 8A and 8B, the wiring conductor 21*c* is formed on an upper surface of the module substrate 20*c*, one end thereof is coupled to the upper coupling electrode 21, and the other end thereof is coupled to the lower coupling electrode 25*c* with the via conductor 23*c* interposed therebetween. The wiring conductor 21*c* is an example of a wiring coupled in series with the main line 11. At least a part (for example, a portion C) of the wiring conductor 21*c* overlaps with the sub-line 12 in plan view.

In the coupler module 1*c*, the wiring conductor 21*c* is coupled to an input end (an end portion on the input port IN side) of the main line 11. Thus, it is considered that the coupling degree in the reverse direction, of the coupling degree in the forward direction and the coupling degree in the reverse direction, can be selectively increased due to the asymmetry of the circuit.

As described above, by providing, on the module substrate, the wiring which is coupled in series with the main line and at least partially overlaps with the sub-line, it is possible to increase the effective coupling degree of the directional coupler. In particular, it is possible to selectively increase the coupling degree in the reverse direction by coupling the wiring at least a part of which overlaps with the sub-line to the input end of the main line. Thus, it is possible to obtain the directional coupler having better characteristics in which a mismatch between the coupling degree in the forward direction and the coupling degree in the reverse direction is improved, for example, when the coupling degree in the reverse direction is lower than the desired coupling degree.

Embodiment 3

A coupler module according to Embodiment 3 will be described.

Each of FIGS. 9A and 9B is a diagram illustrating an example of a structure of a coupler module according to Embodiment 3, and FIG. 9A is a plan view and FIG. 9B is a side view. As illustrated in FIGS. 9A and 9B, in a coupler module 1*d*, a wiring conductor 22*d* is added to a module substrate 20*d*, and the arrangement of a via conductor 24*d* and a lower coupling electrode 26*d* is changed as compared with the coupler module 1 in FIGS. 2A and 2B. The coupler component 10 is not changed. In FIGS. 9A and 9B, constituent elements that are added to or changed from the coupler module 1 among the constituent elements of the module substrate 20*d* are highlighted by hatching lines, and the signs of some constituent elements among the constituent elements of the coupler component 10 are omitted.

As illustrated in FIGS. 9A and 9B, the wiring conductor 22*d* is formed on an upper surface of the module substrate 20*d*, one end thereof is coupled to the upper coupling electrode 22, and the other end thereof is coupled to a lower coupling electrode 26*d* with a via conductor 24*d* interposed therebetween. The wiring conductor 22*d* is an example of a wiring coupled in series with the main line 11.

At least a part (for example, a portion D) of the wiring conductor 22*d* overlaps with the sub-line 12 in plan view. Since the portion D of the wiring conductor 22*d* is arranged so as to overlap with the sub-line 12, the effective coupling degree of the directional coupler can be increased by forming the capacitive coupling between a part of the wiring and the sub-line, similarly to the coupler module 1*b* illustrated in FIGS. 6A and 6B.

In the coupler module 1*d*, the wiring conductor 22*d* is disposed further away from the main line 11 than the coupler module 1*b*. With such arrangement, an area increases in which the sub-line 12 overlaps with the main line 11 and the line conductor 22*d* through which a main signal flows in the same direction as the main line 11, and thus, a magnetic flux acting on the sub-line 12 among the magnetic fluxes generated by the main signal flowing through the main line 11 and the wiring conductor 22*d* increases, and the coupling degree can be further increased in the coupler module 1*d* as compared with the coupler module 1*b*.

FIG. 10 is a graph showing an example of the effective coupling degree of the directional coupler in the coupler module 1*d*. In the example of FIG. 10, at a frequency of 3.7 GHz assumed to be utilized, a coupling degree FWD in the forward direction is −25.2 dB, and a coupling degree REV in the reverse direction is −24.2 dB.

From FIG. 10 and FIG. 7, in the coupler module 1*d*, the coupling degree in the forward direction is 0.7 dB larger than that in the coupler module 1*b*, and the coupling degree in the reverse direction is 0.6 dB larger than that in the coupler module 1*b*.

As described above, the coupling degree can be further increased by disposing the wiring at least a part of which overlaps with the sub-line so as to be further away from the main line.

The coupler module of the present disclosure has been described above based on the embodiments, but the present disclosure is not limited to the individual embodiments. Configurations in which various modifications that are conceived by those skilled in the art are adopted to the embodiments, or configurations created by combining constituent elements in different embodiments without departing from the spirit of the present disclosure may also be included in the scope of one or a plurality of aspects of the present disclosure.

For example, FIGS. 3A and 3B illustrate the example in which the direction of the main signal flowing through the main line 11 and the direction of the main signal flowing in the portion A are opposite to each other in the wiring conductor 22*a* having the portion A along the main line 11, but the present disclosure is not limited to this example. The wiring conductor may be provided such that the direction of the main signal flowing through the main line and the direction of the main signal flowing in the portion along the main line of the wiring conductor are the same as each other.

Each of FIGS. 11A and 11B is a diagram illustrating an example of a structure of a coupler module according to a modified example, and FIG. 11A is a plan view and FIG. 11B is a side view. As illustrated in FIGS. 11A and 11B, in a coupler module 1*e*, a wiring conductor 22*e* is added to a module substrate 20*e*, and the arrangement of a via conductor 24*e* and a lower coupling electrode 26*e* is changed as compared with the coupler module 1 in FIGS. 2A and 2B. The coupler component 10 is not changed. In FIGS. 11A and 11B, constituent elements that are added to or changed from the coupler module 1 among the constituent elements of the module substrate 20*e* are highlighted by hatching lines, and the signs of some constituent elements among the constituent elements of the coupler component 10 are omitted.

As illustrated in FIGS. 11A and 11B, the wiring conductor 22*e* is formed on an upper surface of the module substrate 20*e*, one end thereof is coupled to the upper coupling electrode 22, and the other end thereof is coupled to the lower coupling electrode 26*e* with the via conductor 24*e* interposed therebetween. The wiring conductor 22*e* is an example of a wiring coupled in series with the main line 11.

At least a part (for example, a portion E) of the wiring conductor 22*e* is provided along the main line 11. Here, the fact that the part of the wiring conductor 22*e* is along the main line 11 means that a distance between a part of the wiring conductor 22*e* and the main line is kept substantially constant.

In the coupler module 1*e*, a direction of a main signal flowing through the main line 11 is the same as a direction of the main signal flowing in the portion E of the wiring conductor 22*e*. Thus, it is considered that magnetic fields in the same direction are generated by the main signal in or around the portion E of the wiring conductor 22*e* and in or around the main line 11, a magnetic field acting on the sub-line is strengthened, and the effective coupling degree of the directional coupler increases.

As described above, by providing, on the module substrate, a wiring which is coupled in series with the main line, at least a part of which is along the main line, and in which the direction of the main signal flowing through the part is the same as the direction of the main signal flowing through the main line, the effective coupling degree of the directional coupler can be increased.

In addition, in the coupler module 1*e*, a part of the wiring conductor 22*e* in plan view is provided along the sub-line 12 in the portion E, for example. Here, the fact that the part of the wiring conductor 22*e* is along the sub-line 12 means that a distance between the part of the wiring conductor 22*e* and the sub-line is kept substantially constant.

As described above, by providing a part of the wiring conductor in plan view so as to be along the sub-line, a magnetic field generated by the main signal on a part of the wiring is caused to act on the sub-line, and the effective coupling degree of the directional coupler can be further increased.

In addition, in the embodiments and the modified examples, in FIGS. 3A, 3B, 6A, 6B, 8A, 8B, 9A, 9B, 11A, and 11B, the structure is exemplified in which the upper coupling electrode and the lower coupling electrode on the module substrate are at the same position in plan view of the substrate, but the present disclosure is not limited to this example. The lower coupling electrode of the module substrate may be disposed at any position, for example, through a wiring conductor provided in an inner layer of the module substrate.

The lower coupling electrode of the module substrate according to the embodiments and the modified examples may be arranged at the same position as the lower coupling electrode in the coupler module 1 having the basic structure, for example. This makes it possible to obtain a coupler module in which positions of the electrodes are interchangeable and the coupling degree of the directional coupler is adjusted, compared to the coupler module 1 having the basic structure.

Additionally, the wiring provided on the module substrate may not be formed on the upper surface of the module substrate. For example, even when the wiring coupled in series with the main line is formed inside the module substrate, a similar effect can be obtained as long as a shield layer is not interposed between the wiring and the coupler component. In this case, the closer the distance between the wiring and the main line or the sub-line is, the more easily the coupling degree of the directional coupler is adjusted by using magnetic field coupling or capacitive coupling.

SUMMARY

As described above, the coupler module according to an aspect of the present disclosure includes a component formed with a main line and a sub-line that configure a directional coupler, and a substrate on which the component is mounted and on which a wiring coupled in series with the main line is formed, and at least a part of the wiring is along the main line in plan view of the substrate.

With this, a magnetic field obtained by synthesizing the magnetic fields generated by a main signal in or around a part of the wiring with the magnetic fields generated in or around the main line is caused to act on the sub-line, capacitive coupling is formed between the part of the wiring line and the sub-line, and thus, an effective coupling degree of the directional coupler can be adjusted. For example, in a case where the coupling degree is deviated when the directional coupler is mounted on the substrate, the coupling degree can be corrected by changing the wiring of the substrate so as to have a portion along the main line in plan view of the substrate. Since the portion of the wiring along the main line can be provided in a region overlapping with the directional coupler in plan view of the substrate, the coupling degree can be adjusted without an increase in size of the coupler module. Further, since the substrate is modified, the coupling degree can be adjusted at a low cost and in a short period of time, as compared with a case where the directional coupler itself is corrected.

In addition, a direction of the main signal flowing through the main line and a direction of the main signal flowing through the at least part of the wiring may be opposite to each other.

As a result, magnetic fields in opposite directions to each other are generated by the main signal in or around the portion of the wiring conductor and in or around the main line, a magnetic field acting on the sub-line is weakened, and thus it is possible to reduce the effective coupling degree of the directional coupler.

In addition, the direction of the main signal flowing through the main line may be the same as the direction of the main signal flowing through the at least part of the wiring.

Due to this, the magnetic fields in the same direction are generated by the main signal in or around the portion of the wiring and in or around the main line, the magnetic field acting on the sub-line is strengthened, and thus, the effective coupling degree of the directional coupler can be increased.

A coupler module according to an aspect of the present disclosure includes a component formed with a main line and a sub-line that configure a directional coupler, and a substrate on which the component is mounted and on which a wiring coupled in series with the main line is formed, and at least a part of the wiring overlaps with the sub-line in plan view of the substrate.

Accordingly, since capacitive coupling is formed between a part of the wiring and the sub-line, the effective coupling degree of the directional coupler can be increased. For example, in a case where the coupling degree is insufficient when the directional coupler is mounted on the substrate, the coupling degree can be compensated by changing the wiring on the substrate so as to have a portion overlapping with the sub-line in plan view of the substrate. Since the portion of the wiring overlapping with the sub-line can be provided in a region overlapping with the directional coupler in plan view of the substrate, the coupling degree can be adjusted without an increase in size of the coupler module. Further, since the substrate is modified, the coupling degree can be adjusted at a low cost and in a short period of time, as compared with a case where the directional coupler itself is corrected.

Further, the wiring may be coupled to an output end of the main line.

This makes it possible to selectively increase the coupling degree in the forward direction of the coupling degree in the forward direction and the coupling degree in the reverse direction. For example, when the directional coupler is mounted on the substrate, in a case where the coupling degree in the forward direction is much less than the coupling degree in the reverse direction, imbalance in coupling degree can be reduced.

Further, the wiring may be coupled to an input end of the main line.

This makes it possible to selectively increase the coupling degree in the reverse direction of the coupling degree in the forward direction and the coupling degree in the reverse direction. For example, when the directional coupler is mounted on the substrate, in a case where the coupling degree in the reverse direction is much less than the coupling degree in the forward direction, it is possible to reduce the imbalance in coupling degree.

In addition, the at least part of the wiring may be along the sub-line.

Thus, the effective coupling degree of the directional coupler can be further adjusted by causing the magnetic field generated in or around the part of the wiring by the main signal to act on the sub-line in addition to the capacitive coupling formed between the part of the wiring and the sub-line.

Additionally, the at least part of the wiring may be formed on a main surface on a side of the substrate on which the component is mounted.

This makes it possible to more reliably form the capacitive coupling or the magnetic field coupling between the at least part of the wiring and the sub-line. Therefore, the effective coupling degree of the directional coupler can be more easily adjusted.

The present disclosure is widely usable as a coupler module in which a directional coupler is mounted.

1, 1*a*, 1*b*, 1*c*, 1*d*, 1*e* COUPLER MODULE
10 COUPLER COMPONENT
11 MAIN LINE
12 SUB-LINE
13, 14 VIA CONDUCTOR
15, 16 COUPLING ELECTRODE
20, 20*a*, 20*b*, 20*c*, 20*d*, 20*e* MODULE SUBSTRATE
21, 22 UPPER COUPLING ELECTRODE
21*c*, 22*a*, 22*b*, 22*d*, 22*e* WIRING CONDUCTOR
23, 23*c*, 24, 24*a*, 24*b*, 24*d*, 24*e* VIA CONDUCTOR
25, 25*c*, 26, 26*a*, 26*b*, 26*d*, 26*e* LOWER COUPLING ELECTRODE
30 CONDUCTIVE BONDING MATERIAL

The invention claimed is:

1. A coupler module comprising:

a component comprising a main line, a sub-line, a plurality of via conductors, and a plurality of coupling electrodes, wherein the main line and subline constitute a directional coupler; and a first substrate on which the component is mounted, and on which a wiring coupled in series with the main line is provided, wherein the main line, the sub-line, the plurality of via conductors, and the plurality of coupling electrodes, are formed on or in a second substrate, wherein at least a part of the wiring is along the main line in plan view of the first substrate.

2. The coupler module according to claim 1, wherein a direction of a main signal flowing through the main line and a direction of the main signal flowing through the at least part of the wiring are opposite to each other.

3. The coupler module according to claim 2, wherein the at least part of the wiring is along the sub-line.

4. The coupler module according to claim 2, wherein the at least part of the wiring is provided on a main surface on a side of the first substrate on which the component is mounted.

5. The coupler module according to claim 1, wherein a direction of a main signal flowing through the main line and a direction of the main signal flowing through the at least part of the wiring are the same as each other.

6. The coupler module according to claim 5, wherein the at least part of the wiring is along the sub-line.

7. The coupler module according to claim 5, wherein the at least part of the wiring is provided on a main surface on a side of the first substrate on which the component is mounted.

8. The coupler module according to claim 1, wherein the at least part of the wiring is provided on a main surface on a side of the first substrate on which the component is mounted.

9. The coupler module according to claim 1, wherein the at least part of the wiring is along the sub-line.

10. The coupler module according to claim 9, wherein the at least part of the wiring is provided on a main surface on a side of the first substrate on which the component is mounted.

11. A coupler module comprising:

a component provided with a main line and a sub-line configuring a directional coupler; and a substrate on which the component is mounted, and on which a wiring coupled in series with the main line is provided, wherein at least a part of the wiring overlaps with the sub-line in plan view of the substrate.

12. The coupler module according to claim 11, wherein the wiring is coupled to an input end of the main line.

13. The coupler module according to claim 12, wherein the at least part of the wiring is along the sub-line.

14. The coupler module according to claim 12, wherein the at least part of the wiring is provided on a main surface on a side of the substrate on which the component is mounted.

15. The coupler module according to claim 11, wherein the at least part of the wiring is along the sub-line.

16. The coupler module according to claim 11, wherein the at least part of the wiring is provided on a main surface on a side of the substrate on which the component is mounted.

17. The coupler module according to claim 11, wherein the wiring is coupled to an output end of the main line.

18. The coupler module according to claim 17, wherein the at least part of the wiring is along the sub-line.

19. The coupler module according to claim 17, wherein the at least part of the wiring is provided on a main surface on a side of the substrate on which the component is mounted.

* * * * *